United States Patent [19]

Looper

[11] 4,244,523

[45] Jan. 13, 1981

[54] APPARATUS FOR CLEANING TANKS OR VESSELS

[76] Inventor: Bruce T. Looper, 405 48th St., NW., Bradenton, Fla. 33507

[21] Appl. No.: 20,655

[22] Filed: Mar. 15, 1979

[51] Int. Cl.[3] ..... B08B 9/08

[52] U.S. Cl. ..... 239/227; 118/317; 134/167 R; 134/181; 239/248; 239/264; 239/559

[58] Field of Search ..... 134/167 R, 172, 181, 134/198; 239/225, 227, 246, 248, 264, 554, 558, 559, 587; 118/317, 323

[56] References Cited

U.S. PATENT DOCUMENTS

| | | | |
|---|---|---|---|
| 1,880,272 | 10/1932 | Panther, Jr. | 239/587 X |
| 2,661,983 | 12/1953 | Endsley | 239/227 |
| 3,645,452 | 2/1972 | Stoeckel et al. | 239/227 |
| 3,895,756 | 7/1975 | Jaeger | 239/227 |

FOREIGN PATENT DOCUMENTS

| | | | |
|---|---|---|---|
| 230074 | 8/1960 | Australia | 118/317 |

*Primary Examiner*—Andres Kashnikow
*Attorney, Agent, or Firm*—Benjamin P. Reese, II

[57] ABSTRACT

An improved apparatus for cleaning large tanks or vessels, such as automotive and railway tank cars. A tiltable frame having a wash nozzle assembly pivotedly mounted thereon is pivotedly mounted above a fixed support frame. The tiltable frame has, fixedly mounted thereon, an air motor which is operatively connected to a first gear box which, in turn, is operatively connected to a second gear box. The first gear box is operatively connected to the wash nozzle assembly to move said assembly back and forth along the longitudinal axis of the tank or vessel to be cleaned. The second gear box is operatively connected to the fixed support frame to tilt the tiltable frame and thereby move the wash nozzle in both directions along the latitudinal axis of the tank or vessel to be cleaned.

16 Claims, 9 Drawing Figures

APPARATUS FOR CLEANING TANKS OR VESSELS

BACKGROUND & SUMMARY OF THE INVENTION

This invention relates to an improved apparatus and method for cleaning large tanks or vessels, such as, for example, automotive and railway tank cars.

It is imperative in many industrial operations to thoroughly clean the interior surfaces of large tanks or vessels. Such cleaning is usually done by manual labor. But, manual cleaning is a tedious and time consuming task. Furthermore, manual cleaning may expose the worker to toxic or corrosive substances and vapors and otherwise create a hazardous environment for the worker. Thus, automatic cleaning apparatus and methods are desirable.

The phosphoric acid industry presents a typical large tank or vessel cleaning situation. Phosphoric acid is shipped in rubber-lined automotive or railway tank cars having only a small access opening at the top. Gypsum and other solids precipitate during the period of transportation from the acid manufacturing plant to the ultimate destination. As a result of such precipitation, a sticky, acid-rich sludge is deposited on the sides and bottom of each tank car. Because the amount of sludge present in each tank car is often substantial, standard industry practice is to clean or remove the sludge from the interior surface of each tank car after each round trip made by the car.

Various apparatus and methods for cleaning automotive and railroad tank cars and other large tanks or vessels have been proposed. Some of the proposed apparatus and methods, such as shown in U.S. Pat. No. 3,895,756, are routinely used in industrial cleaning operations.

Each of the known apparatus for cleaning large tanks or vessels has one or more major disadvantages. For example, known apparatus are either too large or too heavy, or both, for one worker to conveniently move the apparatus from location to location and position it over and in the access opening at the top of the tank or vessel to be cleaned. And, known apparatus are incapable of thoroughly cleaning the entire interior surface of a typical large tank or vessel, such as, for example, an automotive or railway tank car. Furthermore, known apparatus either cost too much to manufacture or clean too slowly, or both, for economical cleaning of large tanks or vessels. These disadvantages are not inherent in the present invention.

The apparatus of the present invention is comprised of a fixed support frame and a tiltable frame which is pivotedly mounted above the support frame. A wash nozzle assembly for insertion through the access opening of the tank or vessel to be cleaned and into the tank or vessel is pivotedly mounted to the tiltable frame. The wash nozzle assembly is comprised of a spray head having at least one pair of opposed spray nozzles and a cleaning liquid inlet tube. One end of the cleaning liquid inlet tube remains outside the tank or vessel to be cleaned and is connected to a source of pressurized cleaning liquid by a flexible hose or other suitable liquid supply line. During operation of the apparatus, the wash nozzle assembly is pivoted back and forth at an operator controlled rate to direct cleaning liquid spray jets along the longitudinal axis of the tank or vessel to be cleaned. At the same time, the tiltable frame upon which the wash nozzle assembly is pivotedly mounted is tilted at an operator controlled rate to direct the cleaning liquid spray jets along the latitudinal axis of the tank or vessel. The combination of these two basic movements washes the entire length and width of the tank or vessel to be cleaned with spray jets of cleaning liquid.

To achieve these basic movements, a motor or engine drives a first gear box which pivots the wash nozzle assembly by means of a lever arm mechanism. The first gear box drives a second gear box which tilts the tiltable frame by means of a lever arm mechanism. A conventional drive-shaft mechanism is the preferred means for operatively connecting the motor or engine and the first gear box. A conventional belt and pulley mechanism is the preferred means for operatively connecting the first gear box and the second gear box. For safety reasons, an air motor connected to a remote air supply source by a flexible air hose is the preferred motor or engine. The motor and the first and second gear boxes are fixedly mounted to a tiltable frame.

The wash nozzle assembly of the present invention features a spray head having at least one pair of opposed spray nozzles. The opposed spray nozzles create opposing forces which result in substantially lower total stress levels in the various components of the apparatus than would be present if a single spray nozzle or a plurality of unopposed spray nozzles were utilized. For that reason, the apparatus of the present invention can be manufactured from components which are small enough and light enough to enable one worker to conveniently move the apparatus from location to location and position it over and in the access opening at the top of the tank or vessel to be cleaned.

The preferred embodiment of the apparatus of the present invention features two alternate spray heads for the wash nozzle assembly. One of the spray heads is comprised of two spray nozzles having an angle of approximately 80° there between. That spray head has proved to be particularly useful for breaking up and flushing out hardened sludges in the bottom of railway tank cars at a faster rate than is possible with known apparatus. The other spray head is comprised of three pairs of opposed spray nozzles. That spray head has proved to be particularly useful for rapidly cleaning liquids and easy to remove solids from the entire interior surface of railway tank cars.

The apparatus of the present invention can be manufactured from simple mechanical components which are available from commercial sources. Accordingly, the apparatus of the present invention is more economical to manufacture than known apparatus.

DESCRIPTION OF THE PREFERRED EMBODIMENT

Figure 1:
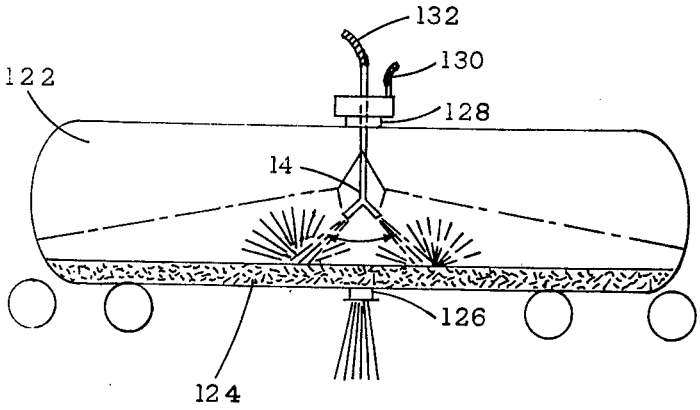
FIG. 1 is an outline elevational view of a railway tank car together with the cleaning apparatus of the present invention.

The preferred embodiment of the large tank or vessel cleaning apparatus of the present invention is illustrated in FIGS. 1–9. As illustrated in FIGS. 3–6, the apparatus is comprised of six major components, namely, a fixed support frame 10, a tiltable frame 12, a wash nozzle assembly 14, an air motor 16, a first gear box 18 and a second gear box 20.

Many of the standard shapes available from commercial suppliers of structural steel and other structural alloys are suitable as structural materials for fabrication of the fixed support frame 10 and the tiltable frame 12. Traditional means for rigidly fastening or joining the individual pieces of the structural material selected can be utilized to fabricate each frame. Welded stainless steel frames having an "L" shaped cross-section are preferred because of their structural characteristics and corrosion resistant characteristics.

Wash nozzle assembly 14 is comprised of a cleaning liquid inlet tube 22 and a spray head. While any pipe or tube having the requisite structural characteristics and the desired interior diameter can be utilized to fabricate cleaning liquid delivery tube 22, stainless steel pipe which has been cut to the desired length is preferred. In the preferred embodiment, conventional external screw threads are provided on ends 24 and 26 of cleaning liquid delivery tube 22.

The design of the particular spray head utilized for cleaning operations is dependent upon the size and shape of the tank or vessel to be cleaned and the nature and location of the material to be removed from that tank or vessel. In the preferred embodiment, the spray head has at least one pair of opposed spray nozzles. When opposed spray nozzles are utilized, the apparatus of the present invention is small enough and light enough for one worker to conveniently move it from location to location and position it over and in the access opening at the top of the tank or vessel to be cleaned. This is possible because the opposed spray nozzles create opposing forces which result in substantially lower total stress levels in the various components of the apparatus than would be present if a single spray nozzle or a plurality of unopposed spray nozzles were utilized. And, of course, the lower total stress levels allow the use of smaller, lighter weight components to manufacture the apparatus of the present invention than would be the case if higher total stress levels were present.

Two alternate spray heads are included in the preferred embodiment of the apparatus of the present invention. Spray head 28 illustrated in FIGS. 3–6 has proved to be particularly useful for breaking up and flushing out hardened sludges in the bottom of automotive and railway tank cars. Spray head 30 illustrated in FIGS. 7–9 has proved to be particularly useful for rapidly cleaning liquids and easy to remove solids from the entire interior surface of automotive and railway tank cars.

As illustrated in FIGS. 3–6, spray head 28 consists of two each of spray jet nozzle 32, two each of pipe segment 34 and one internally threaded pipe coupling 36. Stainless steel is the preferred material for each of these components. Pipe coupling 36 can be purchased from commercial sources or fabricated by cutting and welding segments of pipe to achieve the desired shape. Each spray jet nozzle 32 is machined from rod or bar stock and welded to an unthreaded end of one pipe segment 34. Each pipe segment 34 has an externally threaded end which is screwed into one of the openings of pipe coupling 36 to complete assembly of spray head 28. Spray head 28 is screwed onto end 24 of the cleaning liquid delivery tube to complete assembly of wash nozzle assembly 14.

Figure 7:
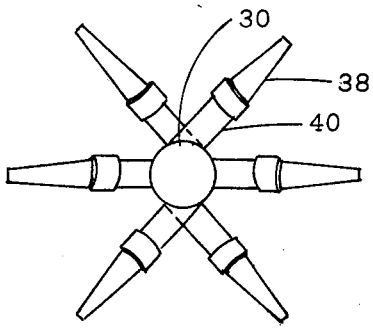
FIG. 7 is a top view of an alternate spray head for the apparatus of the present invention.
Figure 8:
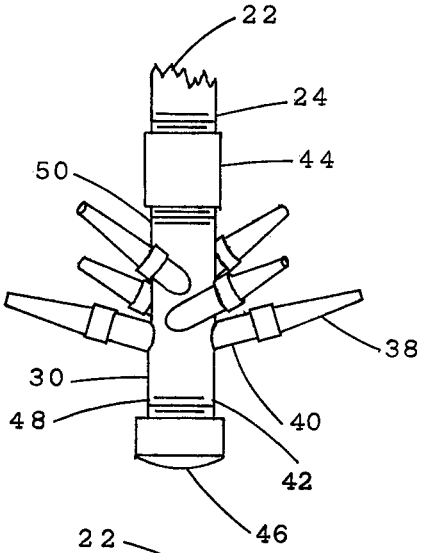
FIG. 8 is an elevational view of the spray head shown in FIG. 7.
Figure 9:
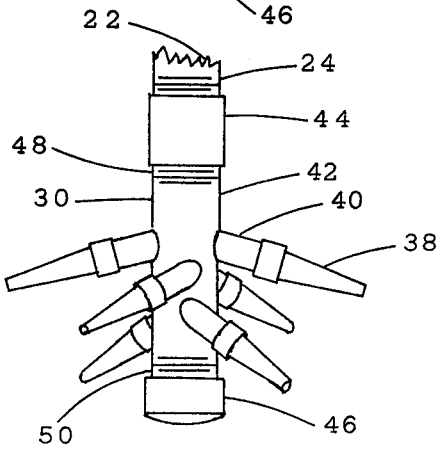
FIG. 9 is an elevational view similar to FIG. 8, but illustrating the spray head attached to the cleaning liquid inlet tube of the wash nozzle assembly with the spray nozzles pointing in a generally downward direction.

As illustrated in FIGS. 7–9, spray head 30 consists of six each of spray jet nozzle 38, six each of pipe segment 40, one pipe segment 42, one internally threaded pipe coupling 44 and one internally threaded pipe closure 46. Stainless steel is the preferred material for each of these components. Conventional external screw threads are provided on ends 48 and 50 of pipe segment 42. Six holes are cut through the wall of pipe segment 42 at appropriate locations. Each spray jet nozzle 38 is machined from rod or bar stock and welded to one end of one pipe segment 40. The other end of each pipe segment 40 is fitted into one of the aforementioned holes through the wall of pipe segment 42 and welded in place at the desired angle. Internally threaded pipe closure 46 is screwed onto end 48 or end 50 to complete assembly of spray head 30. If one desires to clean the upper half of the interior surface of an automotive or railway tank car, internally threaded pipe closure 46 is screwed onto end 48 of pipe segment 42 and internally threaded pipe coupling 44 is screwed onto end 50 of pipe segment 42 and end 24 of the cleaning liquid delivery tube to complete assembly of wash nozzle assembly 14. If one desires to clean the lower half of the interior surface of an automotive or railway tank car, internally threaded pipe closure 46 is screwed onto end 50 of pipe segment 42 and internally threaded pipe coupling 44 is screwed onto end 48 of pipe segment 42 and end 24 of the cleaning liquid delivery tube to complete assembly of wash nozzle 14.

In the preferred embodiment, air motor 16 is a conventional one-third hp variable speed air motor having a speed reduction gear box 17 with a mid-range output speed of approximately 150 rpm and a muffler 19. If appropriate speed reduction means are utilized, any conventional variable speed air motor with at least a one-fourth hp rating can be substituted for the air motor illustrated in FIGS. 3–6. A conventional one-third hp air drill motor has been utilized successfully with the apparatus of the present invention.

First gear box 18 is a Sterling Perfection Gear Box, Model Number ST-1360C, or its equivalent. Second gear box 20 is a Sterling Perfection Gear Box, Model Number ST-1360B, or its equivalent. These gear boxes are available from Sterling Power Systems, Inc., 532 East Emaus Street, Middletown, Pennsylvania 17057. Both of these gear boxes have a 60:1 reduction ratio, a 0.09 hp rating at 1750 rpm input, and a 0.05 hp rating at 29.2 rpm output. First gear box 18 has one input drive shaft and two output drive shafts. Second gear box 20 has one input drive shaft and one output drive shaft.

Air motor 16, first gear box 18 and second gear box 20 are fixedly mounted to tiltable frame 12. FIGS. 3-6 illustrate a support member 52 welded to tiltable frame 12 for mounting air motor 16 for direct driving of first gear box 18 and eight each of headed bolt 54 and nut 56 for mounting first gear box 18 and second gear box 20 to tiltable frame 12. Other traditional fastening means, such as welding, can be utilized to mount each of these components on tiltable frame 12. Flexible coupling half 58 on the output shaft of speed reduction gear box 17 engages flexible coupling half 60 on the input shaft of first gear box 18 to operatively connect air motor 16 and first gear box 18. Flexible belt 64 engaged pulley 66 on the first output shaft of first gear box 18 and pulley 68 on the input shaft of second gear box 20 to operatively connect first gear box 18 and second gear box 20. Flexible belt 65 can be loosened or tightened by lowering or raising adjustable idler 70.

Wash nozzle assembly 14 is pivotedly mounted to tiltable frame 12. This is accomplished by providing, such as by welding, a fixed axle 72 and a fixed axle 74 on opposite sides of cleaning liquid delivery tube 22. Fixed axle 72 rotatably engages the cylindrical portion of slot 76 in member 78 and fixed axle 74 rotatably engages the cylindrical portion of slot 80 in member 82 of tiltable frame 12. Closure rod 84 confines fixed axle 72 to the cylindrical portion of slot 76 and closure rod 86 confines fixed axle 74 to the cylindrical portion of slot 80 during operation of the apparatus. To interconnect wash nozzle assembly 14 and first gear box 18 for operation of the apparatus, end 88 of lever arm 90 is rotatably fastened to fly wheel 92 on the second output shaft of first gear box 18 with headed bolt 94 and nut 96. End 98 of lever arm 90 is provided with a movable quick disconnect fastening device 100 which is connected to lever arm 102 movably attached to fixed axle 72.

Tiltable frame 12 is pivotedly mounted above fixed support frame 10. This is accomplished by providing, such as by welding, a fixed axle 104 on member 108 of fixed support frame 10 for rotatably engaging a round hole in end 11 of tiltable frame 12 and by providing an unthreaded bolt 106 having a head on one end and a hole for a locking pin on the other end for rotatably engaging a round hole in end 13 of tiltable frame 12 and a round hole in member 110 of fixed support frame 10. To interconnect second gear box 20 and fixed support frame 10 for operation of the apparatus, lever arm 112 on the output shaft of second gear box 20 is rotatably connected to end 114 of lever arm 116. End 118 of lever arm 116 is rotatably connected to lever arm 120 movably attached to fixed support frame 10.

Figure 2:
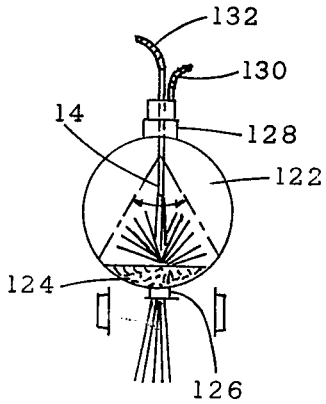
FIG. 2 is an outline end view of the tank car and apparatus.
Figure 3:
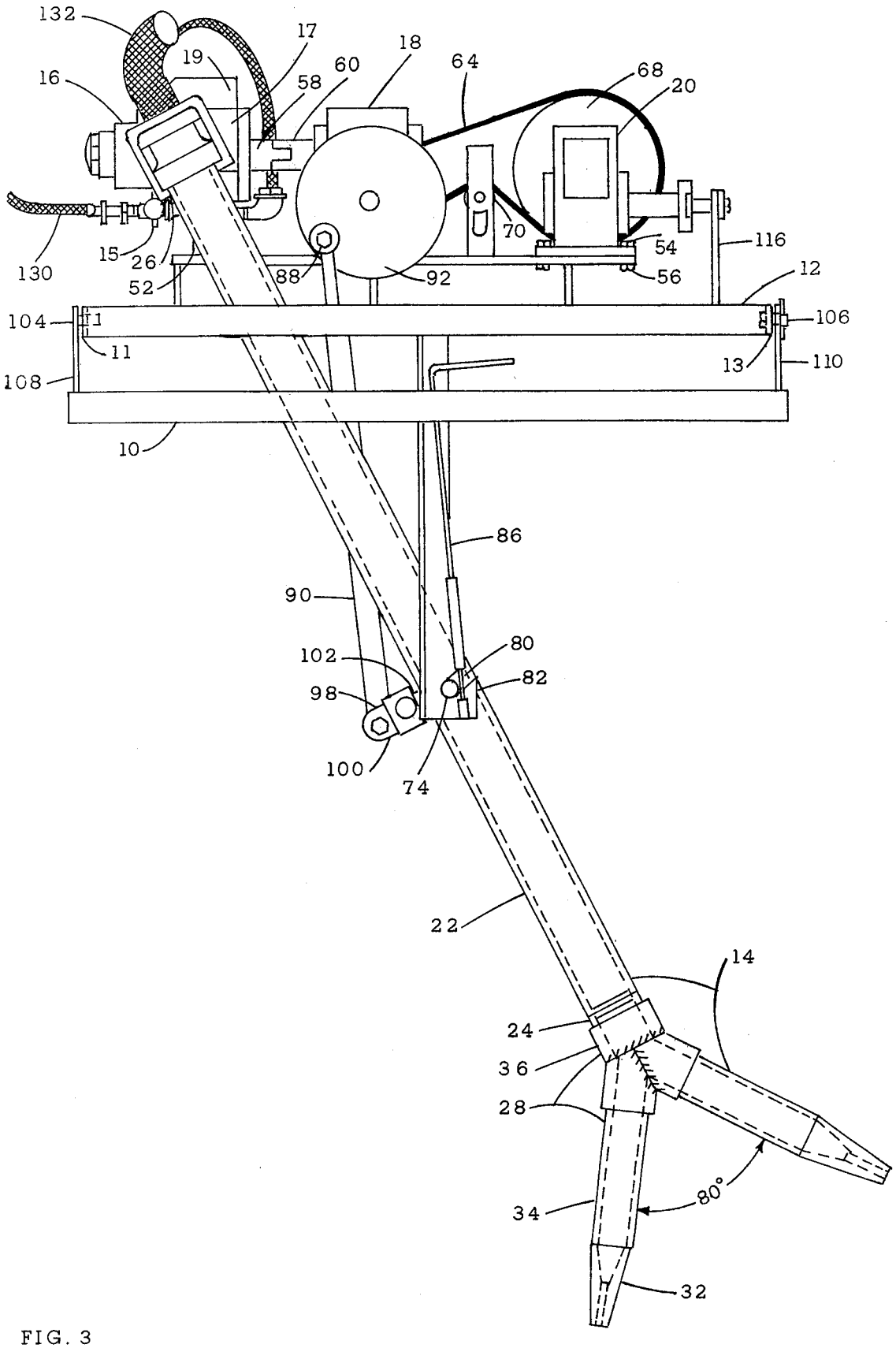
FIG. 3 is an elevational view of the apparatus of the present invention.
Figure 4:
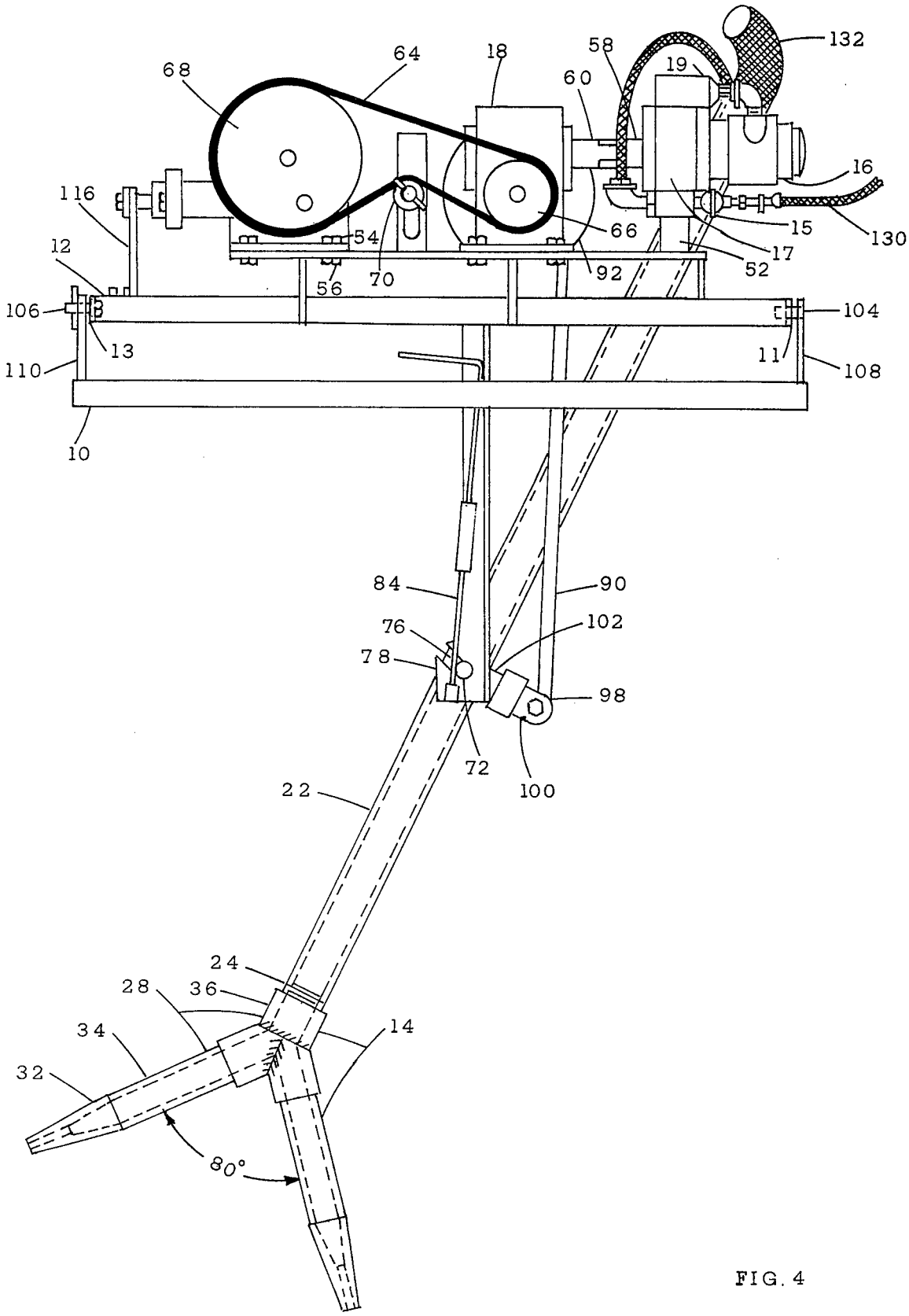
FIG. 4 is an elevational view of the side of the present invention opposite to that shown in FIG. 3.
Figure 5:
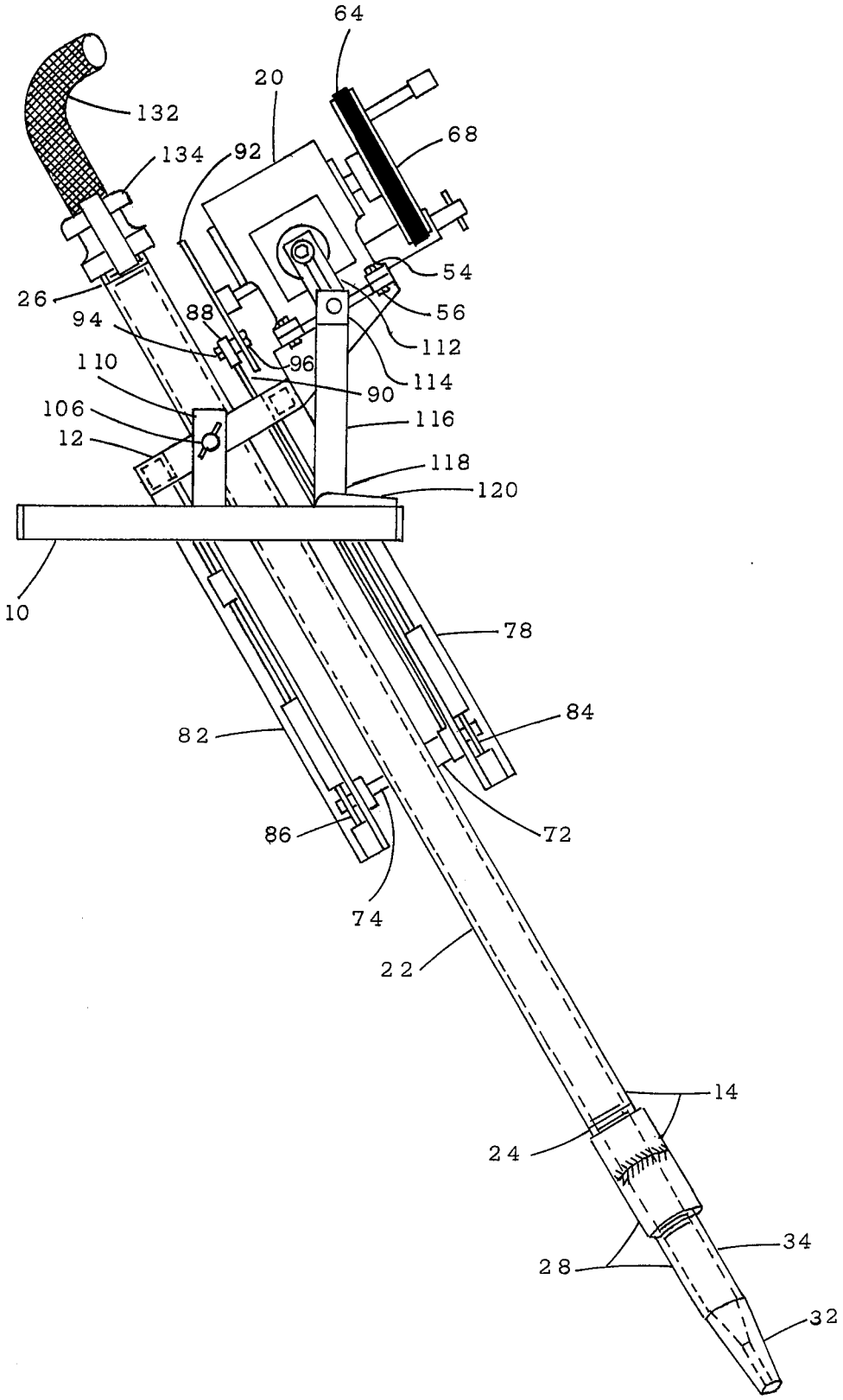
FIG. 5 is an end view of the apparatus of the present invention with the tiltable frame in its maximum tilt position.
Figure 6:
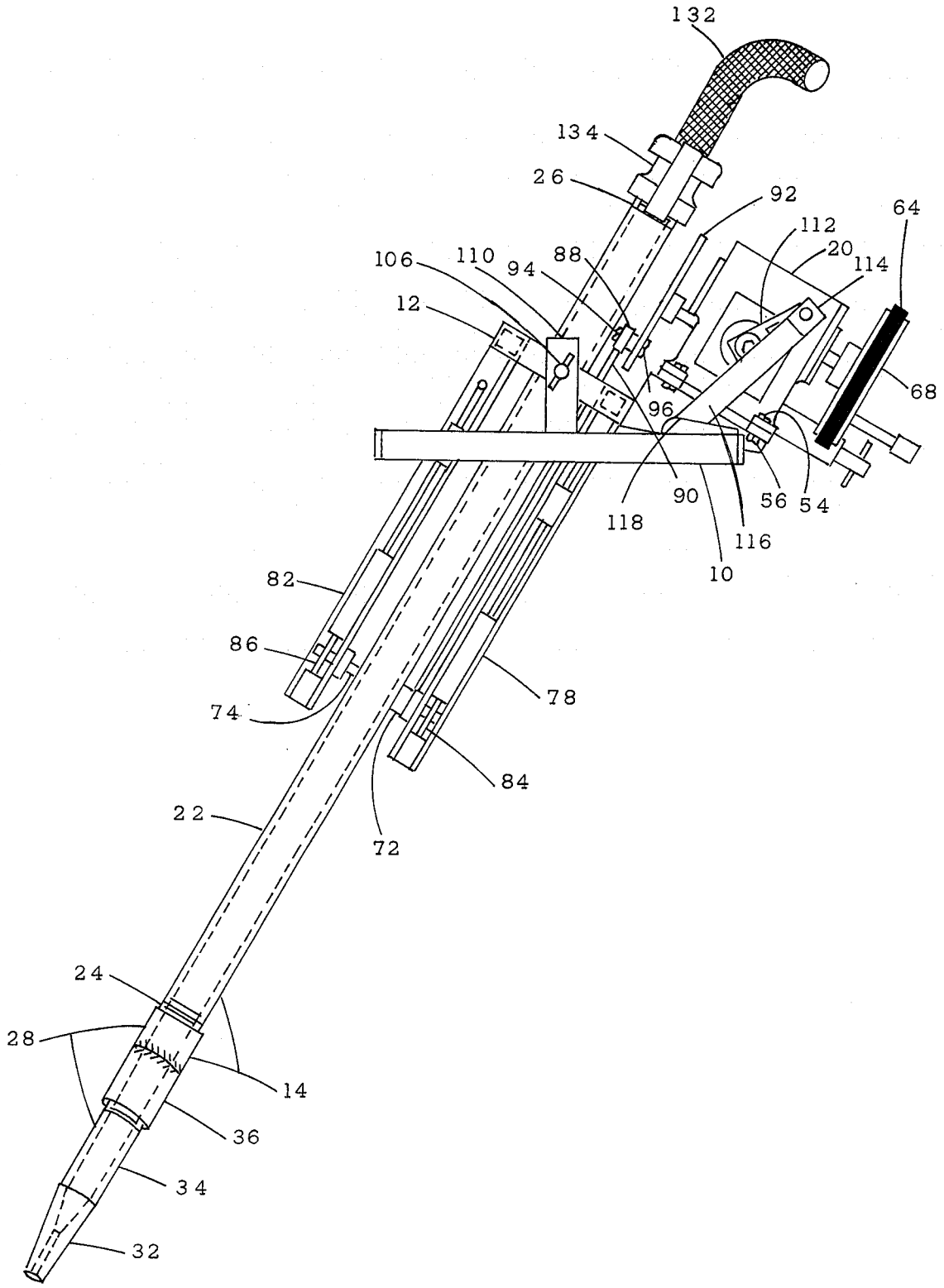
FIG. 6 is an end view of the apparatus of the present invention with the tiltable frame in its maximum tilt position in the direction opposite to that shown in FIG. 5.

The utilization of the apparatus of the present invention in a typical large tank or vessel cleaning situation will now be described. Phosphoric acid is shipped from its manufacturing plant to its ultimate destination in traditional automotive or railway tank cars. Gypsum and other solids precipitate during such shipment and cause a sticky, acid rich sludge to be deposited on the sides and bottom of the interior of each tank car. FIGS. 1 and 2 illustrate an empty railway tank car 122 having a layer of sludge 124 in the bottom.

To clean hardened sludge from the interior of railway tank car 122, the hatch cover of the tank car is removed and drain 126 is opened. The apparatus is positioned above the hatch opening and lowered into the hatch opening until the bottom of fixed support frame 10 engages and rests upon the top of hatch 128. In this position, spray head 28 of wash nozzle assembly 14 is located in the upper most central interior portion of railway tank car 122. Air motor 16 is connected to a conventional air supply source, such as an air compressor, by flexible air hose 130. Preferably, the air supply source is removed from tank car 122. End 26 of cleaning liquid delivery tube 22 is connected to a source of pressurized cleaning liquid by flexible hose 132 having a fast disconnect coupling on the end thereof. Either water or dilute acid can be used as a cleaning liquid. Approximately 100 to 150 psi cleaning liquid pressure is required for cleaning hardened sludges from the sides and bottom of the interior of a railway tank car.

If drain 126 on railway tank car 122 is clogged, it is cleared by either directing a spray jet from spray head 28 at the drain or directing a high pressure liquid jet into drain 126 from the exterior of railway tank car 122. Thereafter, operation of the apparatus is begun by opening valve 15 on air motor 16 with wash nozzle assembly 14 in a straight up and down position. During operation, first gear box 18, by means of the hereinabove described fly wheel and lever arm mechanism, pivots wash nozzle assembly 14 back and forth at an operator controlled rate to direct two cleaning liquid spray jets in an overlapping path along the longitudinal axis of railway tank car 122. At the same time, second gear box 20, by means of the hereinabove described lever arm mechanisms, tilts tiltable frame 12 to direct the cleaning liquid spray jets along the latitudinal axis of railway tank car 122. The combination of these two basic movements causes the cleaning liquid spray jets to be directed in overlapping paths along the entire length and width of sludge 124, thereby eroding the hardened sludge and flushing it out of railway tank car 122 through drain 126.

If only small quantities of unhardened sludge are present in the bottom of railway tank car 122, spray head 30 can be substituted for spray head 28 for more rapid cleaning operations. Also, spray head 30 can be utilized for rapid cleaning of acid residues from the interior surface of railway tank car 122, such as, for example, prior to utilization of the car for shipment of a different product than that previously shipped in the car. Spray head 30 was proved to be particularly effective when it is desired to thoroughly clean railway tank car 122 prior to a routine inspection of the rubber or plastic protective lining used in the interior of the car during acid shipments. For safety reasons, cleaning railway tank car 122 with the apparatus of the present invention prior to such inspections is preferred to the standard industry practice of lowering a worker wearing protective clothing and a protective mask into the car for manual cleaning.

The utilization of the apparatus of the present invention to clean railway tank cars has been described hereinabove. The apparatus of the present invention with either spray head 28 or spray head 30, or both, can be utilized to clean automotive tank cars and other large tanks or vessels. The cleaning procedures utilized would be similar to those described hereinabove.

While the present invention has been disclosed in connection with the preferred embodiment thereof, it should be understood that there may be other embodiments which fall within the spirit and scope of the invention as defined by the following claims.

I claim:

1. An apparatus for cleaning tanks or vessels, comprising:

(a) spray means, pivotedly mounted to a tiltable frame, for forming continuous cleaning liquid spray jets;
(b) mechanical means for continuously moving said spray means back and forth along the longitudinal axis of the tank or vessel to be cleaned;
(c) a gear box, fixedly mounted to said tiltable frame and operatively connected to a fixed support frame by a lever arm mechanism, for continuously moving said spray means to direct said spray jets in both directions along the latitudinal axis of the tank or vessel to be cleaned simultaneously with the operation of said mechanical means; and
(d) power means for driving said mechanical means and said gear box.

2. An apparatus for cleaning tanks or vessels as recited in claim 1, wherein said mechanical means for continuously moving said spray means back and forth along the longitudinal axis of the tank or vessel to be cleaned is a gear box operatively connected to said spray means by a lever arm mechanism.

3. An apparatus for cleaning tanks or vessels, comprising:
(a) a fixed support frame;
(b) a tiltable frame pivotedly mounted above said fixed support frame;
(c) a wash nozzle assembly pivotedly mounted to said tiltable frame;
(d) an air motor fixedly mounted to said tiltable frame;
(e) a first gear box fixedly mounted to said tiltable frame;
(f) a second gear box fixedly mounted to said tiltable frame;
(g) means for operatively connecting said air motor and said first gear box;
(h) means for operatively connecting said first gear box and said second gear box;
(i) means for operatively connecting said first gear box and said wash nozzle assembly; and
(j) means for operatively connecting said second gear box and said fixed support frame.

4. An apparatus for cleaning tanks or vessels as recited in claim 3, wherein said wash nozzle assembly is comprised of a cleaning liquid inlet tube and a spray head.

5. An apparatus for cleaning tanks or vessels as recited in claim 4, wherein said spray head has at least one pair of opposed spray jet nozzles.

6. An apparatus for cleaning tanks or vessels as recited in claim 4, wherein said spray head has one pair of opposed spray jet nozzles which emit streams of high pressure cleaning liquid in a vertical plane and with an angle of approximately 80° between said streams.

7. An apparatus for cleaning tanks or vessels as recited in claim 4, wherein said spray head has three pairs of opposed spray jet nozzles which emit streams of high pressure cleaning liquid in a generally radial manner with approximately equal angles between said streams.

8. An apparatus for cleaning tanks or vessels as recited in claim 3, wherein said means for operatively connecting said air motor and said first gear box is a flexible coupling.

9. An apparatus for cleaning tanks or vessels as recited in claim 3, wherein said means for operatively connecting said first gear box and said second gear box is a belt and pulley mechanism.

10. An apparatus for cleaning tanks or vessels as recited in claim 3, wherein said means for operatively connecting said first gear box and said wash nozzle assembly is a lever arm mechanism.

11. An apparatus for cleaning tanks or vessels as recited in claim 3, wherein said means for operatively connecting said second gear box and said fixed support frame is a lever arm mechanism.

12. An apparatus for cleaning tanks or vessels, comprising:
(a) a fixed support frame;
(b) a tiltable frame pivotedly mounted above said fixed support frame;
(c) a wash nozzle assembly pivotedly mounted to said tiltable frame;
(d) an air motor fixedly mounted to said tiltable frame;
(e) a first gear box fixedly mounted to said tiltable frame;
(f) a second gear box fixedly mounted to said tiltable frame;
(g) a flexible coupling to operatively connect said air motor and said first gear box;
(h) a belt and pulley mechanism for operatively connecting said first gear box and said second gear box;
(i) a lever arm mechanism for operatively connecting said first gear box and said wash nozzle assembly; and
(j) a lever arm mechanism for operatively connecting said second gear box and said fixed support frame.

13. An apparatus for cleaning tanks or vessels as recited in claim 12, wherein said wash nozzle assembly is comprised of a cleaning liquid inlet tube and a spray head.

14. An apparatus for cleaning tanks or vessels as recited in claim 13, wherein said spray head has at least one pair of opposed spray jet nozzles.

15. An apparatus for cleaning tanks or vessels as recited in claim 13, herein said spray head has one pair of opposed spray jet nozzles which emit streams of high pressure cleaning liquid in a vertical plane and with an angle of approximately 80° between said streams.

16. An apparatus for cleaning tanks or vessels as recited in claim 13, wherein said spray head has three pairs of opposed spray jet nozzles which emit streams of high pressure cleaning liquid in a generally radial manner with approximately equal angles between said streams.

* * * * *